United States Patent [19]

Stollery

[11] Patent Number: 4,897,972

[45] Date of Patent: Feb. 6, 1990

[54] OBSERVATION TOWER

[76] Inventor: David J. Stollery, 3203 Bern Ct., Laguna Beach, Calif. 92651

[21] Appl. No.: 355,504

[22] Filed: May 22, 1989

[51] Int. Cl.[4] ..... E04H 1/12

[52] U.S. Cl. ..... 52/94; 52/204; 52/207

[58] Field of Search ..... 52/207, 202, 204, 94; 114/71; 43/1; 49/502, 504

[56] References Cited

U.S. PATENT DOCUMENTS 4,364,322 12/1982 Van Roon ..... 114/71

4,416,089 11/1983 Lambke ..... 52/207

*Primary Examiner*—John E. Murtagh

*Attorney, Agent, or Firm*—Charmasson & Holz

[57] ABSTRACT

A molded door and mating door jamb for a observation tower enclosure includes a projection to adapt to a non-vertical structure on one side. The door projection is provided to avoid a projecting wall structure experienced by present day door jamb structures in enclosures having glare reducing slanted windows. A generally planar door is hinged to a vertical door jamb on the opposing side, but has a triangular projection on the non-vertical, slanted window side to adapt to the slanted door jamb construction. The door is hinged to open outward and away from the observer's forward area of interest. The molded door avoids a door jamb and adaptor sections which may obstruct the guard's view as he or she opens the door and exits. The molded door can also provide additional structural support for shutters and roof structure when closed. The door can also include seals, locks and windows for added security, protection and visibility.

14 Claims, 2 Drawing Sheets

FIG. 1
(PRIOR ART)
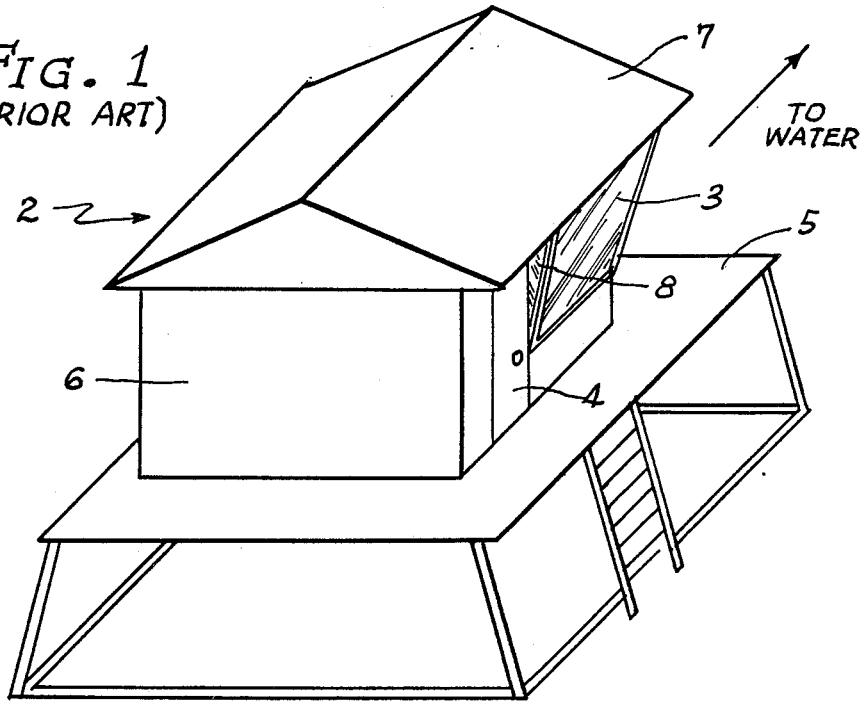
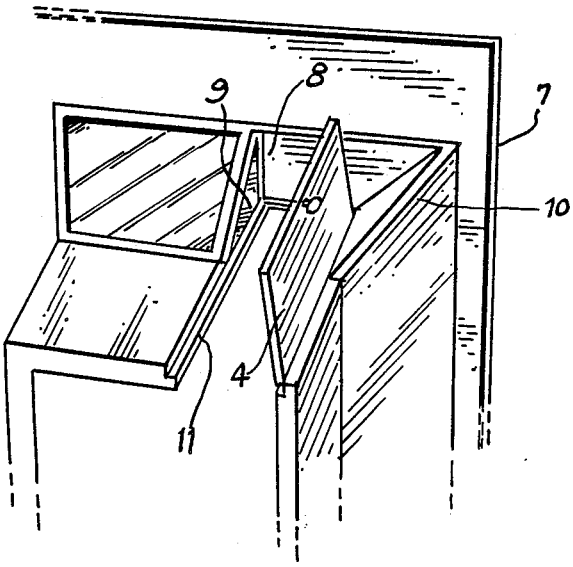
FIG. 2
(PRIOR ART)
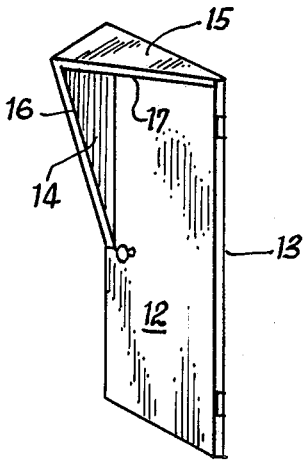
FIG. 3

OBSERVATION TOWER

FIELD OF THE INVENTION

This invention relates to raised platform observation and guard towers. More specifically the invention relates to personnel entrance and exit port design of beach lifeguard tower structures which provide an enclosed personnel space having an overhanging roof.

BACKGROUND OF THE INVENTION

The primary objectives of an enclosed guard tower are to: protect the guards from the environment; provide maximum observational visibility; and allow quick access and egress for guards in emergency situations. If the tower is used on the beach for lifeguards, it should be light weight for easy seasonal transport to and from the beach location. It should also be small so that it will not interfere with the use of the beach, rugged in construction, pleasing in appearance and low in cost. When the tower is stored during the off season, a minimum of effort to convert from a storage mode to an operational mode is also desirable.

Specifically, if the enclosed tower is to provide full protection from the environments during operation and storage, as well as quick exit and egress, it must include at least one conveniently operated door to the enclosure. The door must meet this quick exit/egress requirement without impeding the guard's visibility during egress/exit.

Most of the current lifeguard towers may do one of these objectives well, but other objectives poorly or not at all. Open towers provide maximum visibility, but little or no protection from the environment. All glass enclosures may not provide sufficient protection form the environment, especially shade from the sun. Normal enclosed structures having a structure to support a roof (and vertical walls and windows) may limit visibility. A major drawback of this type of vertical wall construction is the glare and reflection from the glass windows during certain periods of the day. Roof support structure may also detract from quick access and egress objectives.

One approach is to provide an enclosure having angled (nonvertical), windows and an overhanging roof. The angled window design provides that the top of the window is outboard of the lower part of the window. This positioning reflects some of the low angle glare when the sun (or other source of the glare) is low in the sky or proximate to the horizon, but allows maximum visibility in these low angle directions. High angle sources of glare are totally eliminated by the overhanging roof.

This approach resolves many of the visibility and enclosure needs, but creates a difficult structure to provide quick access/egress without compromising visibility. Normal vertical doors would require a vertical door jamb and triangular wall sections to adapt from the vertical door to the angled window frame structure. The door jamb and triangular wall section structures tend to be unappealing and awkward, also limiting access and use. Most importantly for this application, these wall structures impede visibility at a critical time.

Visibility is most necessary from when the guard first observes an emergency and exits the enclosure to react to emergency. The lifeguard, for example, needs to maintain visual contact with the drowning victim or other emergency during this critical exiting and reaction time. The vertical door jamb and structural triangular wall and window frame adapter sections create a blind spot, necessarily impeding this critical visibility just as the guard exits the enclosure.

These prior approaches have other many limitations. These are primarily related to the incompatibility of the slanted window and window frame construction with the vertical doors. The vertical door provides little or no support of the roof because of the incompatibility. The structure at the door jamb must be structurally reinforced to support the roof at this point. The multiplicity of elements required to accomplish the adaption to the slanted window and window frame design and roof support, creates added cost, weight and space. This multiplicity of elements, weight and space particularly detract from the reliability of the structure.

Although a slanted door could be used, opening the door would be limited to inward directions unless a step down is provided. This changed direction of opening or step down would distract and delay the exit of the guard during these critical emergency periods. A slanted portion of a vertically hinged door could be used, hinged attachment could only be placed on a vertical portion of the door, resulting in problems similar to the full vertical door. In addition, provision (space and structural support) for the slanted door portion would have to be made when the door was open. Sealing the slanted portion against the environment presents still other problems.

Another problem with prior art construction is the support of shutters. Shutters are provided to protect the windows and doors from extreme storms or other strong environmental forces. The prior art vertical door jamb, triangular adaptor structure must also interface and provide support for the shutters, if included.

None of the prior art guard-like towers having slanted window and overhanging roof construction known to the applicant avoids these vertical door and full or partial triangular adaptor obstruction or slanted door problems. What is needed is a door which can be vertically hinged to open outward, securely hinged along the entire height, but adapt to a slanted window and window frame structure.

SUMMARY OF THE INVENTION

The principal and secondary objects of the invention are:

- to provide a slanted glass type tower egress door;
- to provide maximum visibility during egress; and
- to provide a structure which assists in shutter and roof structural support.

These and other objects are achieved by a generally planar door hinged to a vertical door jamb on one side, but having a triangular adaptor on the other side to adapt to the slanted window frame construction. The door is hinged to open outward and away from the observation area of interest. The observer or guard's view is never obstructed as he or she opens the door and exits. The slanted adaptor can provide additional structural support for shutters and roof structure. The door can also include a window for added visibility.

BRIEF DESCRIPTION OF THE DRAWINGS

FIG. 1 shows a rear perspective view of a prior art observation enclosure having slanted windows;

FIG. 2 shows a bottom perspective view of a similar prior art observation enclosure;

FIG. 3 shows a perspective view of the preferred embodiment of a lifeguard tower enclosure door;

DESCRIPTION OF THE PREFERRED EMBODIMENT

Figure 4:
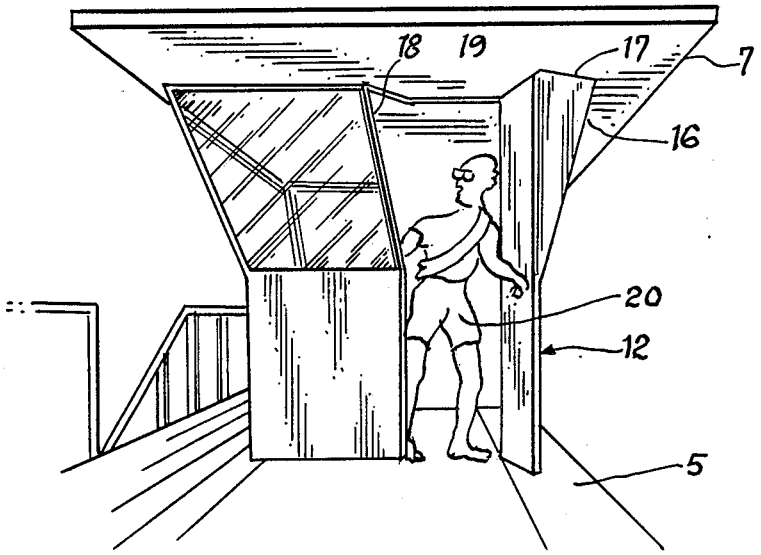
FIG. 4 shows a side view of a lifeguard exiting the lifeguard tower enclosure.

FIG. 1 shows a rear perspective view of a prior art observation enclosure 2 having window panes 3 slanted downwardly and inwardly. The prior art personnel access door 4 is vertically mounted to open outward onto the open portion of the platform 5. The rear portion of the enclosure 6 is shown without windows and having vertical construction. The overhanging roof 7 provides protection against the glare from the sun on the slanted windows 3.

This prior art construction requires a triangular adaptor wall section 8. This adaptor section 8 transitions between the slanted window 3 frame construction and the vertically mounted door 4 jamb. This structure limits visibility in the forward or water direction (see arrow) just as personnel are exiting to handle an emergency such as a drowning victim. Continuous observation may be absolutely critical to a partially obscured and bobbing victim.

FIG. 2 shows a bottom perspective view of a similar prior art observation enclosure. The prior art vertically mounted door is opened outward to allow quick exit by the lifeguard (not shown for clarity). The adaptor section 8 is shown having a triangular window 9, but the door jamb and triangular window framing still partially blocks visibility during this critical period. This adaptor section also requires the guard to observe through two windows, one in the adaptor section and the other normal slanted front or side windows 3. The structural support 10 of the overhanging roof 7 allows a wide opening of the prior art door 4. The vertical door jamb 11 allows straightforward sealing of the enclosure against the environment.

FIG. 3 shows a perspective view of the preferred embodiment of a lifeguard tower enclosure door. The molded door 24 comprises a first door panel section 12 which is vertically attached to the enclosure 6 at a hinged edge 13, a second door panel section 14 and a third door panel section 15 replace the prior art adaptor section 8 (see FIG. 2. The side sealing surface 16 provides a direct interface with the slanted window frame (see FIG. 4) and the top sealing surface 17.

FIG. 4 shows a side view of a lifeguard exiting an lifeguard tower enclosure having the molded door 24. The side sealing surface 16 mates with the slanted window frame 18. The top sealing surface 17 (see FIG. 3) mates with the top portion of the door jamb 19. This construction allows the lifeguard 20 to maintain visual contact while exiting through the molded door 24. When closed, the molded door 12 also can provide additional structural integrity and overhanging roof 7 support. The window frame 18 serves the additional purpose of a door jamb for the molded door 24. The second door panel section 14 being outboard when the door 12 is opened, does not interfere with the door opening or exit of the lifeguard 20 onto the platform 5.

The window frame and door jamb 18 may be upwardly slanted forward (see arrow in FIG. 1) as well as outwardly from the enclosure in alternate configurations. The second door panel section 14 would extend to the forwardly slanted window frame and door jamb 18 when the door 24 was closed in this alternate embodiment.

The molded door 24 can be made from a rigid plastic, such as an thermal formed ABS fiberglass reinforced material. A door knob and lock can also be provided for security and protection. Alternate materials of construction include wood, glass or metal. The door may also include windows, additional locks or passages.

Figure 5:
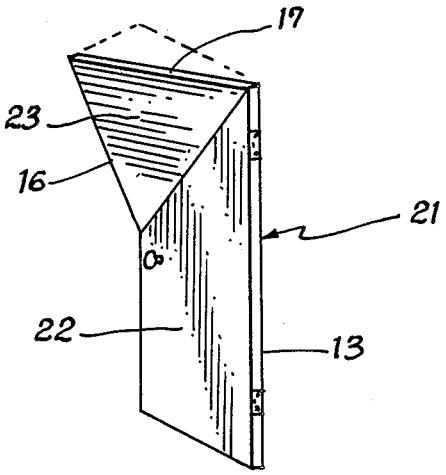
FIG. 5 shows a perspective view of an alternate configuration of a molded door.

FIG. 5 shows a perspective view of an alternate configuration of the molded door. The alternate molded door 21 has a similar hinge edge 13 and sealing surfaces 16 and 17, but integrates the second and third door panel sections 14, 15 of the preferred embodiment (see FIG. 3) into a single piece construction. The construction provides a first vertical panel segment 22 and an intersecting panel segment 23, which extends to the sealing surfaces when the molded door 24 is closed (see FIG. 4). The sealing surfaces adjacent to the window panel (see FIG. 4) may also be upwardly slanted forward as well as outward.

While the preferred embodiment of the invention has been shown and described, and some alternative embodiments also shown and described, changes and modifications may be made therein within the scope of the appended claims without departing from the spirit and scope of this invention.

What is claimed is:

1. A tower-like enclosure having at least one nonvertical peripheral window with a substantially transparent pane, and at least one door and a generally quadrangular door jamb structure adjacent to one of said window panes, the improvement comprising:
   - a first door jamb section attached parallel and adjacent to a nonvertical edge of said one window pane;
   - an opposing generally vertical door jamb section attached to said enclosure.
   - a first door panel section generally in a vertical plane;
   - a second generally vertical door panel section attached to and angled away from the plane of said first door panel section and generally extending from said first door panel section to said first door jamb section when said door is closed; and
   - means for hingably attaching a vertical edge of said first door panel section to said opposing door jamb.

2. The improvement of claim 1, wherein the first door panel is generally quadrangular and the second door panel is generally triangular.

3. The improvement of claim 1 which further comprises:
   - a generally vertical window support structure below said nonvertical window pane; and
   - a second generally vertical door jamb section attached parallel and adjacent to said window support structure.

4. The improvement of claim 1, wherein said door further comprises third door panel section extending horizontally from the top edge of said first door panel section to a line joining the upper ends of said jambs.

5. The improvement of claim 4, wherein said third door panel section is generally triangular in shape.

6. The improvement of claim 1, wherein said first door panel section further comprises a viewing port.

7. The improvement of claim 1, wherein said door opens outwardly and said jambs include a means for sealing said door.

8. The improvement of claim 1, wherein said enclosure also comprises a triangular protrusion to adapt an adjacent nonvertical section of another one of said window panes to said vertical door jamb section.

9. The improvement of claim 1, wherein said first and second door panel sections are generally composed of a rigid transparent plastic material.

10. The improvement of claim 1, wherein said first and second door panel sections are moldable.

11. The improvement of claim 1, wherein said enclosure also comprises an overhanging roof.

12. The improvement of claim 1, wherein said window panes are generally in a forward section of said enclosure.

13. The improvement of claim 1, wherein said first and second door panels are generally planar shaped, said first door panel is attached to said second door panel at the intersecting line of contact common to both planar slopes.

14. The improvement of claim 1, wherein the upper portion of said window panes are relatively more outboard of the enclosure than the lower portion of said window panes.

* * * * *